US007407367B2

(12) United States Patent
McAuliffe et al.

(10) Patent No.: US 7,407,367 B2
(45) Date of Patent: Aug. 5, 2008

(54) VARIABLE AREA DIFFUSER

(75) Inventors: Christopher McAuliffe, Windsor, CT (US); Craig Beers, Wethersfield, CT (US); Brent Merritt, Southwick, MA (US); Robert Telakowski, Windsor Locks, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 543 days.

(21) Appl. No.: 11/108,286

(22) Filed: Apr. 18, 2005

(65) Prior Publication Data

US 2006/0062666 A1 Mar. 23, 2006

Related U.S. Application Data

(60) Provisional application No. 60/612,303, filed on Sep. 22, 2004.

(51) Int. Cl.
*F04D 29/46* (2006.01)

(52) U.S. Cl. ..... 415/150; 415/9; 415/148; 415/160; 415/164

(58) Field of Classification Search ..... 415/9, 415/148, 150, 159, 160, 161, 162–166; 60/602
See application file for complete search history.

(56) References Cited

U.S. PATENT DOCUMENTS

| | | | | |
|---|---|---|---|---|
| 2,976,013 A | | 3/1961 | Hunter | |
| 3,489,339 A | | 1/1970 | Greenwald | |
| 3,799,694 A | | 3/1974 | Duzan | |
| 3,853,433 A | * | 12/1974 | Roberts et al. | 415/160 |
| 3,963,369 A | | 6/1976 | Balje | |
| 4,405,290 A | * | 9/1983 | Rannenberg | 417/282 |
| RE31,835 E | | 2/1985 | Rannenberg | |
| 4,657,476 A | * | 4/1987 | Berg | 415/164 |
| 4,780,049 A | * | 10/1988 | Palmer et al. | 415/150 |

FOREIGN PATENT DOCUMENTS

| | | |
|---|---|---|
| DE | 418479 | 9/1925 |
| DE | 3717590 | 12/1987 |
| EP | 1 413 763 | 8/2006 |
| GB | 731 822 | 6/1955 |
| GB | 2 065 235 | 6/1981 |
| JP | 58015797 | 1/1983 |

OTHER PUBLICATIONS

International Search Report for PCT/US2005/032928, Jun. 22, 2007.

* cited by examiner

*Primary Examiner*—Christopher Verdier
(74) *Attorney, Agent, or Firm*—Carlson, Gaskey & Olds

(57) ABSTRACT

A diffuser includes multiple vanes rotatable about pivot pins between multiple positions. A mounting plate supports a backing plate. The vanes are arranged between the backing plate and the shroud. The pivot pins are in a slip fit relationship with the backing plate, vanes and shroud and are threadingly received by bosses in the mounting plate. The mounting plate and pivot pin arrangement better enables the backing plate and shroud to remain parallel with one another during deflection of the backing plate and/or shroud. Structure, such as integral protrusions and/or bolts, extend from between the backing plate and shroud through apertures in the vanes to better contain the vanes in the event of a catastrophic failure.

14 Claims, 2 Drawing Sheets

VARIABLE AREA DIFFUSER

The present application claims priority to U.S. Provisional Application Ser. No. 60/612,303, filed Sep. 22, 2004.

BACKGROUND OF THE INVENTION

This application relates to a variable area diffuser. In particular, this application relates to a variable area, vane-type-diffuser suitable for use in a compressed air system for an air conditioning pack.

Variable area diffusers utilize multiple vanes that are rotated between different angular positions to vary the throat size of the diffuser. Variable area diffusers can be used in conjunction with, for example, superchargers to vary the flow through an air conditioning system of an aircraft at various altitudes.

The variable area diffuser may be subjected to very high stresses, for example, as the compressor is driven at high speed. The diffuser structure must pass a containment test in which the compressor rotor is rotated at very high speeds until the rotor disintegrates. The debris must stay within its housing so that the debris does not create a hazard to surrounding areas, components or personnel.

Another problem with the diffuser operation is that the structure adjacent to the vanes, such as a backing plate and/or shroud, deflects. It is desirable to maintain a clearance of only a few thousandths on either side of the vane throughout the operation of the diffuser. Deflection of the structure surrounding the vanes can create a binding condition compromising the operation of the diffuser.

What is needed is an improved variable area diffuser with improved operation under applied loads and improved containment of debris in the event of rotor failure.

SUMMARY OF THE INVENTION

The present invention provides a compressed air unit that includes a housing having a shroud. An electric motor driven compressor rotor is arranged in the housing and including rotor blades. A variable area diffuser is arranged in the housing and is in fluid communication with the compressor. The diffuser includes multiple vanes arranged circumferentially around the rotor. The vanes rotate to multiple positions about pivot pins to change the flow through the compressed air system. A mounting plate is secured to the housing by a retainer and supports a backing plate. The vanes are arranged between the backing plate and the shroud.

The pivot pins are in a slip fit relationship with the backing plate, vanes and shroud and are threadingly received by bosses in the mounting plate. With the mounting plate and pivot pin arrangement of the present invention, the backing plate and shroud are better able to remain parallel with one another during loading Structure, such as protrusions and/or fasteners (such as bolts), extend from between the backing plate and shroud through apertures in the vanes to better contain the vanes in the event of a catastrophic failure. Multiple protrusions and bolts are used to act as a barrier to debris, in the example shown.

Accordingly, the invention provides an improved variable area diffuser with improved operation under deflection and improved containment of debris in the event of vane failure.

These and other features of the present invention can be best understood from the following specification and drawings, the following of which is a brief description.

DETAILED DESCRIPTION OF THE PREFERRED EMBODIMENT

Figure 1:
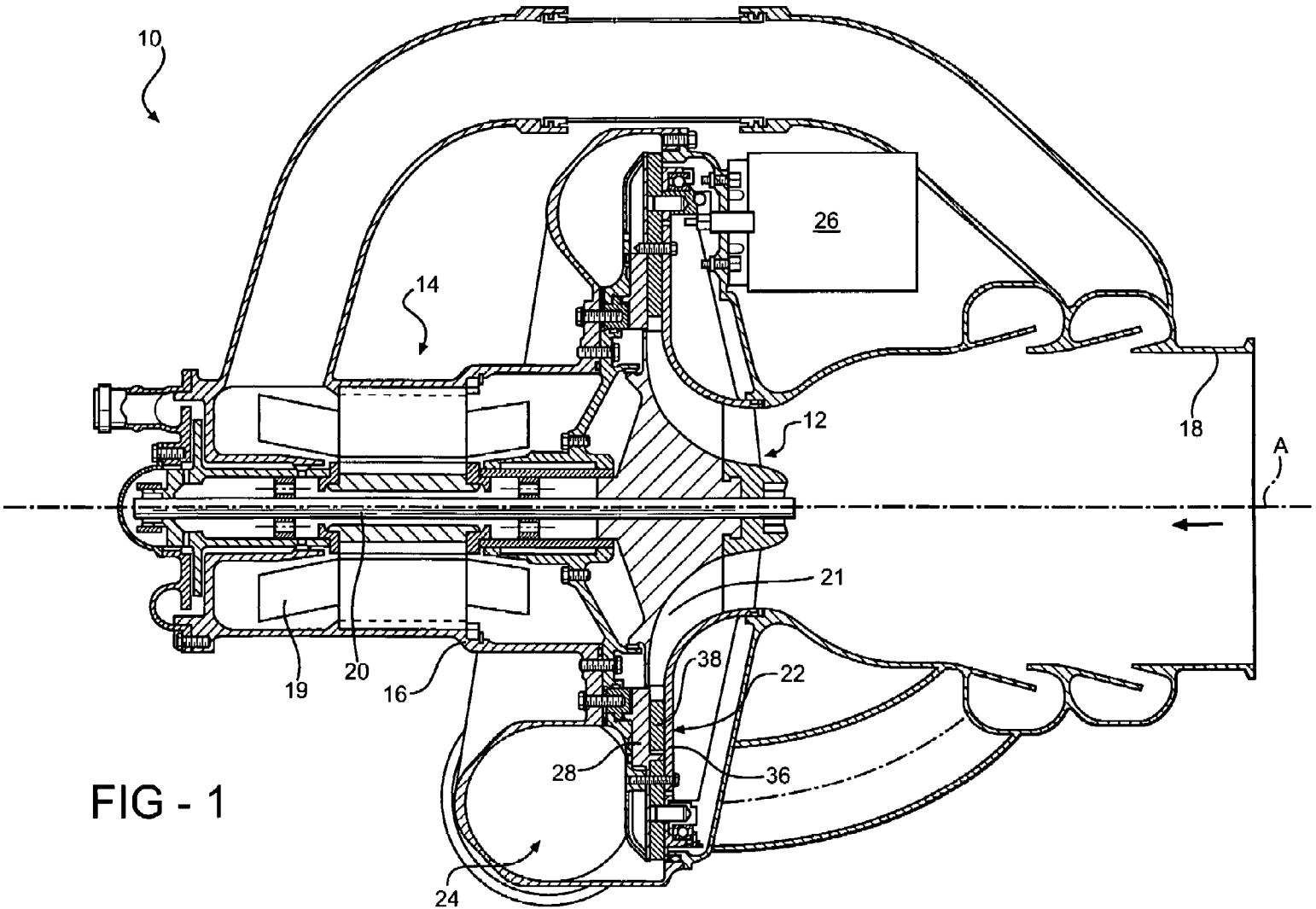
FIG. 1 is a cross-sectional view of a compressed unit system having the inventive variable area diffuser.

A compressed air unit 10 is shown in FIG. 1. The unit 10 includes a compressor rotor 12 driven by an electric motor 14. It should be understood, however, that the inventive diffuser may be used in other, non-electric motor applications. The compressor rotor 12 and electric motor 14 are contained within the housing 16, which may be constructed from multiple housing portions secured to one another. The housing 16 provides an inlet 18 for providing air to the compressor 12. A motor rotor 20 is disposed within a motor stator 19 and is rotatable about an axis A. The rotor 20 supports compressor rotor with blades 21. A diffuser assembly 22 is arranged radially outward of the blades 21. Air drawn through the inlet 18 is pumped radially outwardly to an outlet 24 by the blades 21 through the diffuser 22.

An actuator 26 cooperates with the diffuser 22 to vary the inlet throat (shown at 52 in FIG. 2) to vary the flow rate through the unit 10. In one example, the unit 10 provides pressurized air to an air cycle air conditioning pack of an aircraft.

Figure 2:
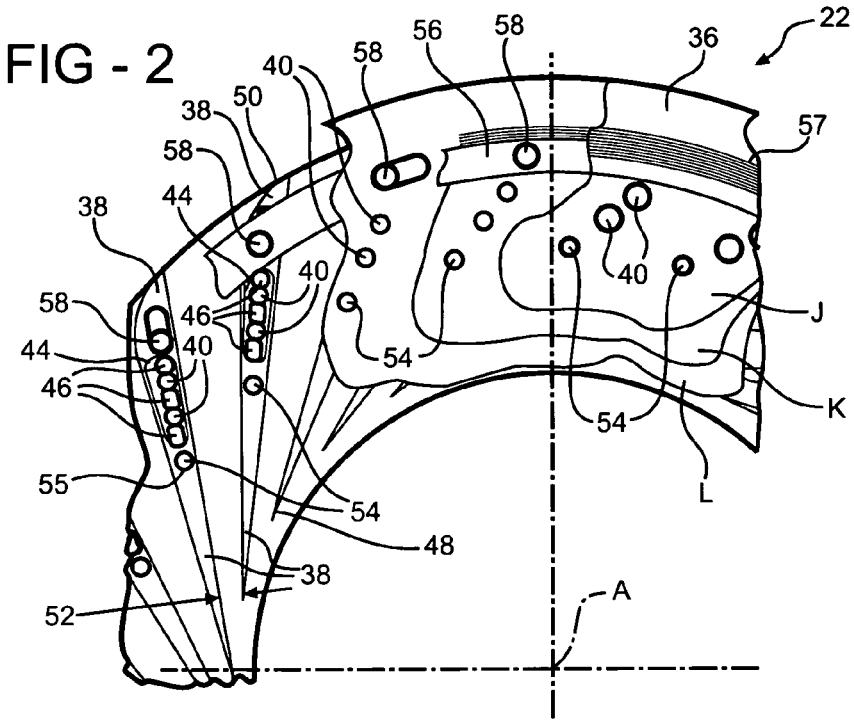
FIG. 2 is a partially broken view of the inventive diffuser, broken at several planes and viewed in the direction of the arrows 2-2 in FIG. 3.
Figure 3:
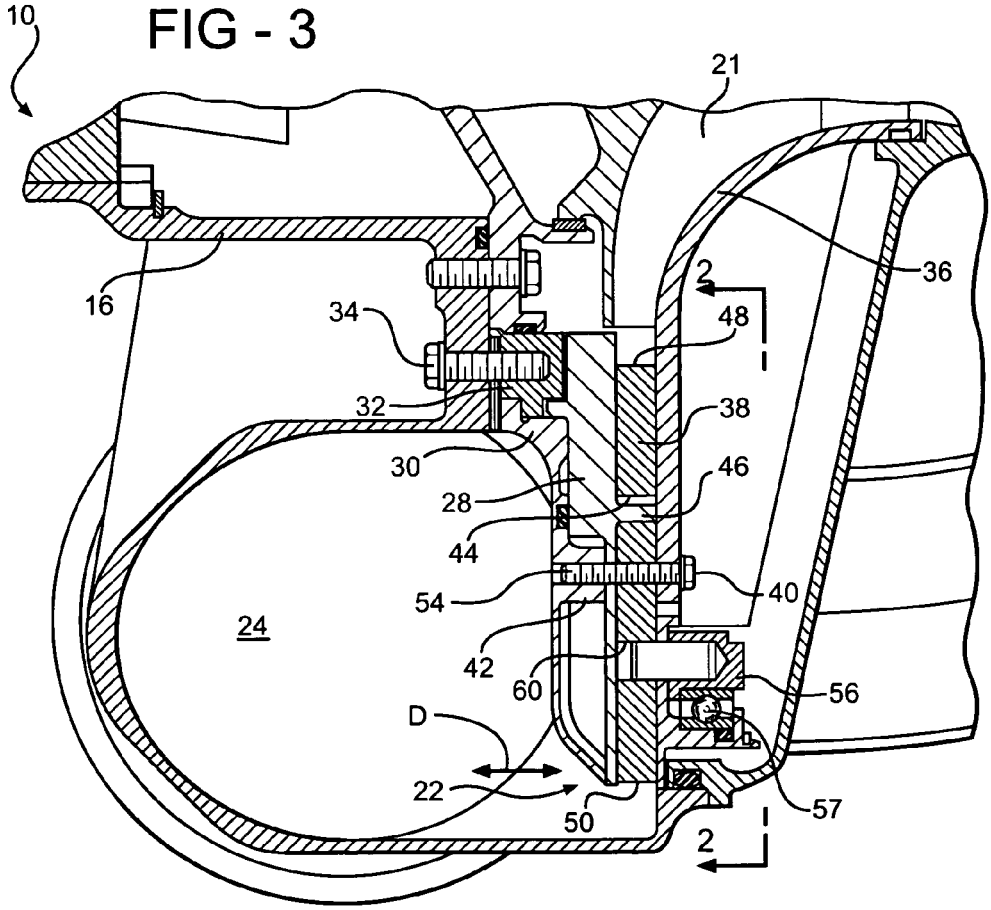
FIG. 3 is an enlarged cross-sectional view of the inventive diffuser shown in FIG. 1.

Referring to FIGS. 2 and 3, the diffuser 22 includes a backing plate 28 that is isolated from deflection D. In conventional devices, the backing plate 28 is secured directly to the housing 16 contributing to the diffuser vanes binding. Instead, the inventive diffuser 22 employs a mounting plate 30 that supports the backing plate 28. The inner and outer periphery of the backing plate 28 is supported by the mounting plate 30, but is also permitted to move axially independently of the mounting plate 30. The mounting plate 30 is secured to the housing 16 by a retainer 32 and fasteners 34.

A shroud 36 is supported by the housing 16 and may deflect axially under load. Multiple vanes 38 are retained between the backing plate 28 and shroud 36 and, typically, a few thousandths of an inch of clearance is provided between the vane 38 and the backing plate 28 and shroud 36. In the example system shown, there are 23 vanes that are modulated between full open and 40% of full open.

The vanes 38 include an inlet end 48 and an outlet end 50. The inlet end 48 provides an adjustable throat 52, shown in FIG. 2, which is provided by pivoting the vanes 38. To provide improved containment, the present invention includes an aperture 44 arranged between the inlet and outlet ends 48 and 50. The aperture is elongated in the direction of the length of the vane 38. Protrusions 46 extend from the backing plate 28 through the aperture 44. In the example shown, the protrusions 46 are integral with the backing plate 28 and extend to engage the shroud 36. Bolts 40, shown in FIG. 2, extend through the aperture 44 to secure the vane 38 between the shroud 36 and backing plate 28. The additional bolts 40 and protrusions 46 of the present invention provide improved containment of the vanes 38 in the event of a failure.

The mounting plate 30 includes a boss 42 for each vane 38. Each vane 38 includes a hole 55 for receiving a pivot pin 54. The pivot pin 54 extends through an opening in the shroud to the mounting plate 30 to secure the vane 38 between the shroud 36 and backing plate 28. An end of the pivot pin 54 is secured into the boss 42. Openings in the backing plate 28, vane 38 and shroud 36 are in a slip fit relationship relative to the pivot pin 54 to permit the shroud 36 and backing plate 28 to deflect axially without binding the vane 38.

The shroud 36 is shown broken along planes J, K and L in FIG. 2 to better illustrate the interrelationship of diffuser components. The vanes 38 include a slot 60 that receives a drive pin 58. The drive pins 58 are mounted on a drive ring 56 that is rotated by the actuator 26 to rotate the vanes 38 about the pivot pins 54. The drive ring 56 includes a bearing 57 supporting the drive ring 56 in the housing 16. The drive pin 58 is received in a slot in the shroud 36 that defines the positional limits of the vanes 38.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A variable area diffuser comprising:

a backing plate and a shroud spaced apart from the backing plate;

a vane arranged between the backing plate and shroud, the vane adjustable between multiple positions, the vane including an aperture;

structure extending from the backing plate towards the shroud through the aperture;

wherein the vane includes a hole, and a pivot pin arranged within the hole, the hole spaced from the aperture, the vane rotatable about the pivot pin between the multiple positions; and wherein a mounting plate supports the backing plate support the backing plate , the pivot pin extending from the shroud into the mounting plate, the pivot pin in a slip fit relationship with the shroud, vane and backing plate.

2. The variable area diffuser according to claim 1, wherein the structure includes a protrusion integral with the backing plate.

3. The variable area diffuser according to claim 1, wherein the mounting plate includes a boss receiving a threaded end of the pivot pin.

4. A variable area diffuser comprising:

a backing plate and a shroud spaced apart from the backing plate;

a vane arranged between the backing plate and shroud, the vane adjustable between multiple positions, the vane including an aperture;

structure extending from the backing plate towards the shroud through the aperture;

wherein the vane includes a hole, and a pivot pin arranged within the hole, the hole spaced from the aperture, the vane rotatable about the pivot pin between the multiple positions;

wherein the structure includes a protrusion integral with the backing plate; and wherein the structure includes a fastener extending through the aperture proximate to the protrusion, said fastener is non-coaxial to said protrusion.

5. The variable area diffuser according to claim 4, wherein the structure includes multiple protrusions and fasteners.

6. A variable area diffuser comprising:

a backing plate and a shroud spaced apart from the backing plate;

a vane arranged between the backing plate and shroud, the vane adjustable between multiple positions, the vane including an aperture;

structure extending from the backing plate towards the shroud through the aperture;

wherein the vane includes a hole, and a pivot pin arranged within the hole, the hole spaced from the aperture, the vane rotatable about the pivot pin between the multiple positions; and wherein a drive ring having a drive pin rotates the vane about the pivot pin, the drive pin received in a slot in the vane.

7. A compressed air unit comprising:

a housing having a shroud;

a compressor arranged in the housing and including rotor blades;

a variable area diffuser arranged in the housing and in fluid communication with the rotor blades, the diffuser including multiple vanes arranged circumferentially and outward of the rotor blades, the vanes rotatable about pivot pins between multiple positions, a mounting plate secured to the housing and supporting a backing plate, the vanes arranged between the backing plate and the shroud; and wherein the mounting plate includes bosses, and the vanes include holes, pivot pins extending from the shroud though the holes and into the bosses.

8. The system according to claim 7, wherein a retainer is secured to the housing with fasteners, the mounting plate arranged between the retainer and the housing.

9. The system according to claim 7, wherein the pivot pins are in a slip fit relationship with the backing plate, vanes and shroud.

10. The system according to claim 7, wherein the vanes include apertures and structure extends from the backing plate through the apertures to the shroud.

11. The system according to claim 10, wherein the structure includes protrusions and fasteners proximate to the protrusions.

12. A compressed air unit comprising:

a housing having a shroud;

a compressor arranged in the housing and including rotor blades;

a variable area diffuser arranged in the housing and in fluid communication with the compressor rotor blades, the diffuser including multiple vanes arranged circumferentially and outward of the rotor blades, the vanes rotatable about pivot pins between multiple positions, a mounting plate secured to the housing and supporting a backing plate, the vanes arranged between the backing plate and the shroud; and wherein a drive ring is supported by the housing on a bearing, the drive ring including drive pins received by slots in the vanes, and an actuator is operatively connected to the drive ring for moving the vanes between the multiple positions.

13. The system according to claim 7, wherein an electric motor is arranged within the housing, the electric motor driving the compressor.

14. The system according to claim 7, wherein the shroud and backing plate are arranged parallel to one another transverse to an axis of rotation of the compressor.

* * * * *